US006753749B1

(12) United States Patent
Chin

(10) Patent No.: US 6,753,749 B1
(45) Date of Patent: Jun. 22, 2004

(54) TOROIDAL TRANSFORMER ENCLOSURE

(75) Inventor: Kwong Kei Chin, Fremont, CA (US)

(73) Assignee: Artesyn Technologies, Inc., Boca Raton, FL (US)

( * ) Notice: Subject to any disclaimer, the term of this patent is extended or adjusted under 35 U.S.C. 154(b) by 0 days.

(21) Appl. No.: 10/455,635

(22) Filed: Jun. 5, 2003

(51) Int. Cl.[7] ..... H01F 27/02
(52) U.S. Cl. ..... 336/90; 336/83
(58) Field of Search ..... 336/83, 84, 90, 336/65, 229

(56) References Cited

U.S. PATENT DOCUMENTS 4,779,812 A * 10/1988 Fisher et al. ..... 242/434.7
6,031,442 A * 2/2000 Nakazawa ..... 336/96
6,081,180 A * 6/2000 Fernandez et al. ..... 336/90
6,512,438 B1 * 1/2003 Yoshimori et al. ..... 336/178

* cited by examiner

*Primary Examiner*—Anh Mai
(74) *Attorney, Agent, or Firm*—Kirkpatrick & Lockhart LLP

(57) ABSTRACT

A toroidal transformer enclosure is disclosed. The toroidal transformer enclosure includes a first housing member and a second housing member structured and arranged to receive the first housing member. The first housing member includes a first end, a first wall and a second wall. The first and second walls are connected to the first end, and the second wall surrounds the first wall. The second housing member includes a second end, a third wall and a fourth wall. The third and fourth walls are connected to the second end, and the fourth wall surrounds the third wall and defines a spacing therebetween. The first and second walls are disposed in the spacing between the third and fourth walls when the first housing member is received by the second housing member.

32 Claims, 11 Drawing Sheets

TOROIDAL TRANSFORMER ENCLOSURE

BACKGROUND

The present invention is related, generally, to a toroidal transformer enclosure. To meet the safety standards issued in the various countries of the world, a transformer must satisfy a host of safety standards regulated by certain agencies in each of the countries. One important safety standard that relates to a transformer is what is commonly known as creeping insulation distance. The creeping distance may be defined as the shortest distance between adjacent conductors measured along the surface of a solid dielectric material interposed therebetween. If the creeping distance between such adjacent conductors is too short, a spark discharge may sometimes arise between the adjacent conductors. Where the insulation between the adjacent conductors is not sufficient, a spark discharge between adjacent conductors may occur.

Whenever high voltage is present, the various safety agencies dictate specific insulation requirements between adjacent conductors of the transformer to minimize the risk of injury to personnel working with or near the transformer.

Many toroidal transformer enclosures, by themselves, do not provide sufficient electrical isolation to meet the required safety standards for high voltage applications. Thus, when such an enclosure is used for high voltage applications, it is known in the art to use additional reinforced insulation around the electrically conductive wires and the termination pins of the transformer to meet the required safety standards. The additional insulation may be in the form of thicker insulation and/or multiple layers of insulation. The additional insulation, however, can increase the overall size of the transformer, increase the complexity of the manufacturing process, and increase the manufacturing cost of the transformer.

It is also known in the art to increase the spacing between uninsulated conductive surfaces of the electrically conductive wires and the termination pins of the transformer to meet the required safety standards for high voltage applications. The increased spacing, however, can also increase the overall size of the transformer and increase the manufacturing cost of the transformer. Without the additional reinforced insulation or the increased spacing, many toroidal transformer enclosures are only suitable for use in low voltage applications.

SUMMARY

In one general respect, the present invention is directed to a toroidal transformer enclosure. According to one embodiment, the toroidal transformer enclosure includes a first housing member and a second housing member structured and arranged to receive the first housing member. The first housing member includes a first end, a first wall-and a second wall. The first and second walls are connected to the first end, and the second wall surrounds the first second wall. The second housing member includes a second end, a third wall and a fourth wall. The third and fourth walls are connected to the second end, and the fourth wall surrounds the third wall and defines a spacing therebetween. The first and second walls are disposed in the spacing between the third and fourth walls when the first housing member is received by the second housing member.

In another general respect, the present invention is directed to a toroidal transformer assembly. According to one embodiment, the toroidal transformer assembly includes a toroidal transformer and a toroidal transformer enclosure. The toroidal transformer enclosure includes a first housing member and a second housing member connected to the first housing member. The first housing member includes a first end, a first wall and a second wall. The first and second walls are connected to the first end, and the second wall surrounds the first wall. The second housing member includes a second end, a third wall and a fourth wall. The third and fourth walls are connected to the second end, and the fourth wall surrounds the third wall and defines a spacing therebetween. The first and second walls are disposed in the spacing between the third and fourth walls. The toroidal transformer is positioned between the first and second walls.

DESCRIPTION

Figure 1:
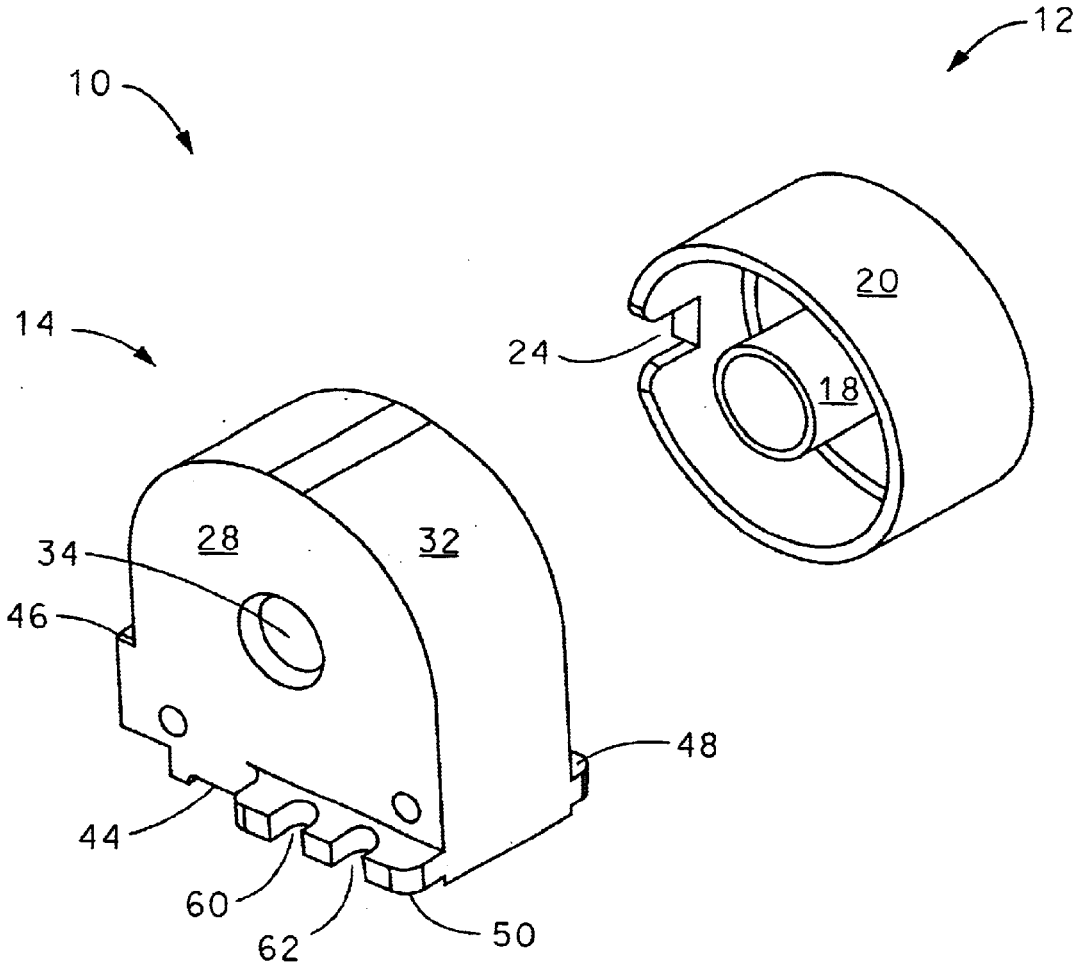
FIG. 1 illustrates one embodiment of a toroidal transformer enclosure.
Figure 2:
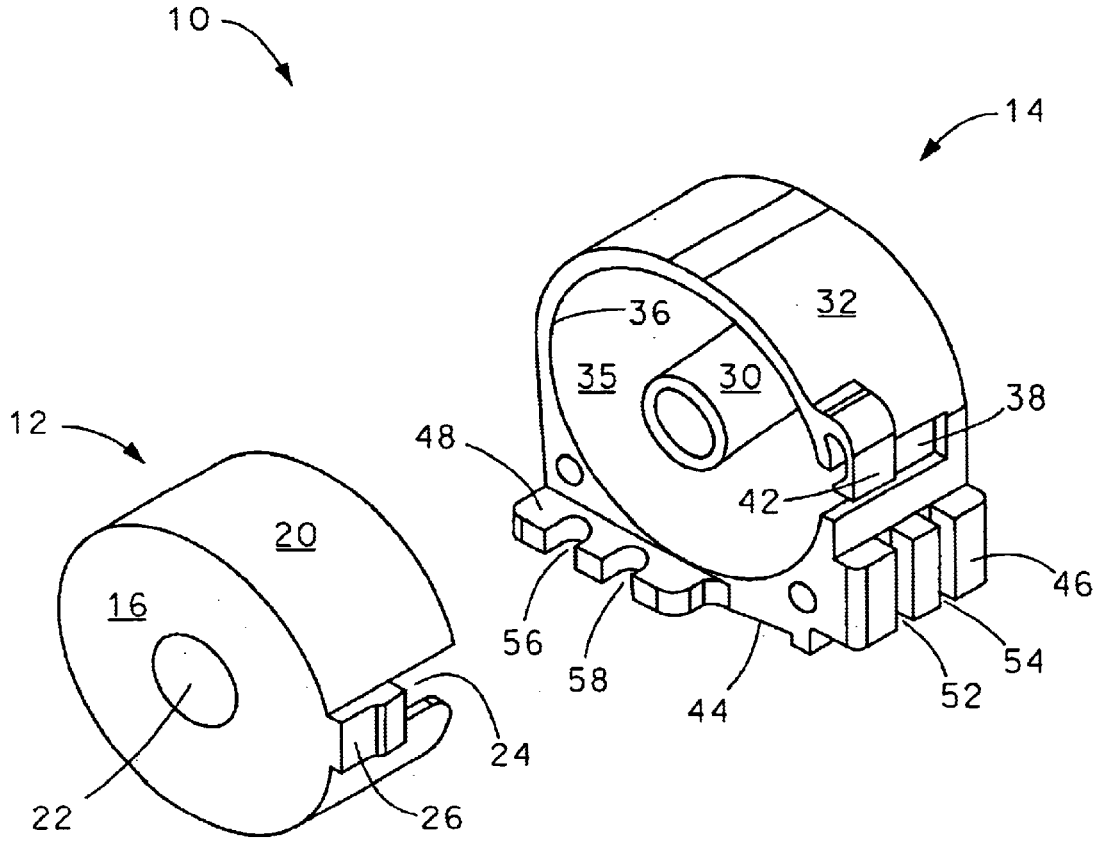
FIG. 2 illustrates one embodiment of a toroidal transformer enclosure.
Figure 3:
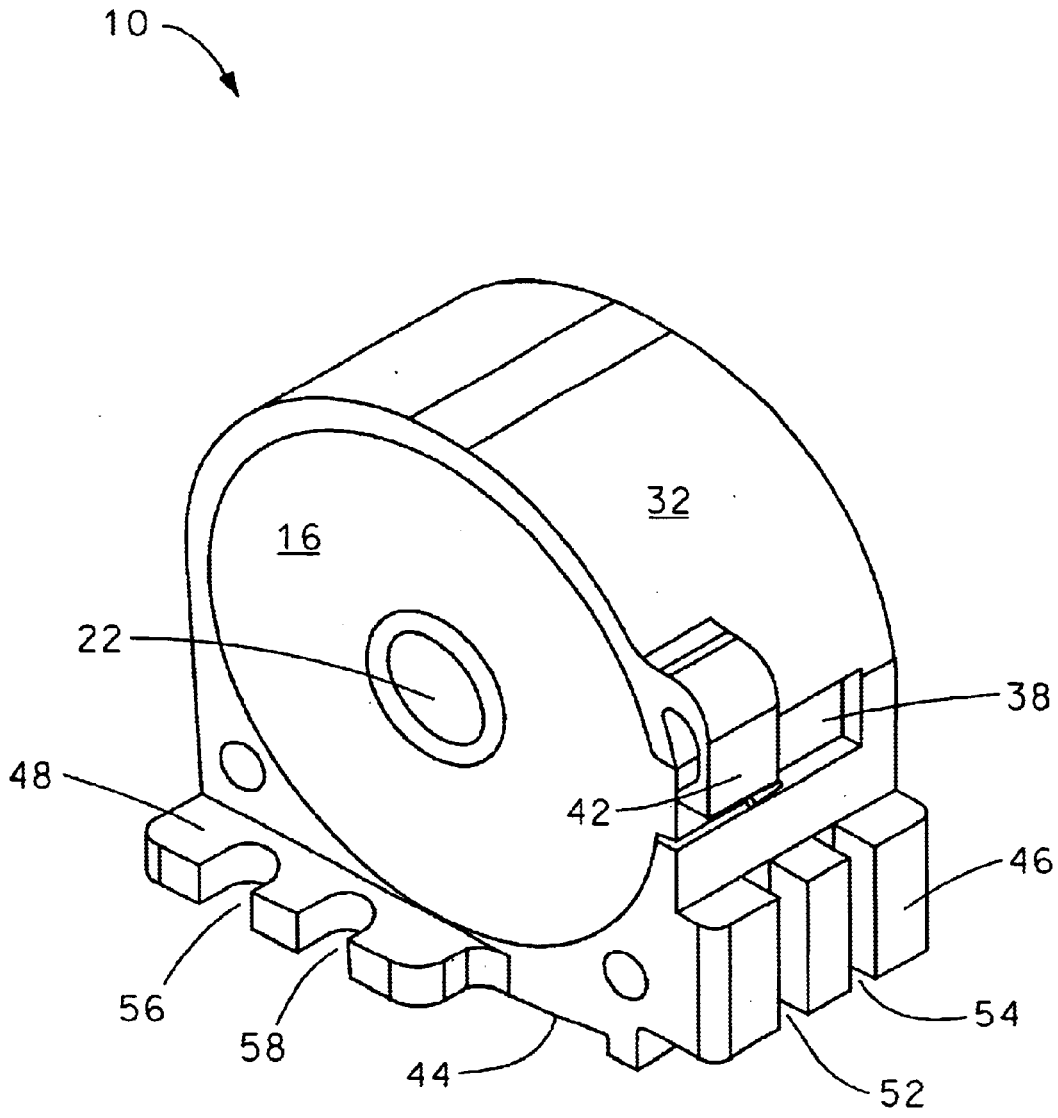
FIG. 3 illustrates one embodiment of a toroidal transformer enclosure.

FIGS. 1–3 illustrate embodiments of a toroidal transformer enclosure 10. The enclosure 10 includes a first housing member 12 and a second housing member 14 structured and arranged to receive the first housing member 12. The first and second housing members 12, 14 may be fabricated from, and therefore comprise, an electrically insulative material such as, for example, plastic. The toroidal transformer enclosure 10 maybe used to enclose a toroidal transformer. For ease of description purposes only, FIGS. 1–2 show the first and second housing members 12, 14 as separated from one another. FIG. 3 shows the first and second housing members 12, 14 connected to each other.

The first housing member 12 includes a first end 16, a first wall 18 connected to the first end 16, and a second wall 20 connected to the first end 16. The first end 16 of the first housing member 12 is substantially planar and defines a first central opening 22. According to one embodiment, the first end 16 is integrally formed with the first and second walls 18, 20. The second wall 20 surrounds the first wall 18. As shown in FIG. 1, the first wall 18 defines a first hollow cylinder and the second wall 20 defines a second hollow cylinder. The second hollow cylinder surrounds the first hollow cylinder. According to one embodiment, the first and second walls 18, 20 are concentric. The second wall 20 also defines a first enclosure opening 24. The first housing member 12 also includes a locking ramp 26. The locking ramp 26 is connected to the second wall 20 and, according to one embodiment, is integrally formed with the second wall 20.

The second housing member 14 includes a second end 28, a third wall 30 connected to the second end 28, and a fourth wall 32 connected to the second end 28. The second end 28 of the second housing member 14 is substantially planar and defines a second central opening 34. According to one embodiment, the second end 28 is integrally formed with the third and fourth walls 30, 32. The fourth wall 32 surrounds the third wall 30, and defines a spacing 35 between the third and fourth walls 30, 32. As shown in FIG. 2, the third wall 30 defines a third hollow cylinder and the fourth wall 32 includes a first surface 36 that defines a fourth hollow cylinder. The fourth hollow cylinder surrounds the third hollow cylinder. According to one embodiment, the third wall 30 and the first surface 36 of the fourth wall 32 are concentric. The fourth wall 32 also defines second enclosure opening 38.

The second housing member 14 also includes a standoff 40 (shown in FIG. 7) and a locking latch 42. The standoff 40 is connected to the first surface 36 of the fourth wall 32 and, according to one embodiment, is integrally formed with the fourth wall 32. The standoff 40 may cooperate with a toroidal transformer positioned within the toroidal transformer enclosure 10 to ensure that any required creeping distances between adjacent conductors of the toroidal transformer are maintained. The locking ramp 26 and the locking latch 42 cooperate to connect the first housing member 12 to the second housing member 14 when the first housing member 12 is received by the second housing member 14. According to one embodiment, the locking latch 42 is integrally formed with the fourth wall 32.

When the first housing member 12 is received by the second housing member 14, as shown in FIG. 3, the first end 16 of the first housing member 12 is opposite the second end 28 of the second housing member 14, the first central opening 22 is opposite the second central opening 34, and the first enclosure opening 24 is aligned with the second enclosure opening 38. In addition, the first wall surrounds the third wall and the fourth wall surrounds the second wall. According to one embodiment, the first wall 18, the second wall 20, the third wall 30 and the first surface 36 of the fourth wall 32 are concentric when the first housing member 12 is received by the second housing member 14.

The second housing member 12 further includes a base 44 connected to the second end 28, a first flange 46 connected to the fourth wall 32, and second and third flanges 48, 50 connected to the base 44. According to one embodiment, the base 44 is integrally formed with the second end 28 and the fourth wall 32.

The first flange 46 includes first and second wiring slots 52, 54. According to one embodiment, the first flange 46 is integrally formed with the fourth wall 32. The second flange 48 includes a third wiring slot 56. The second flange 48 may also include a fourth wiring slot 58 and, according to one embodiment, the second flange 48 is integrally formed with the base 44. The third flange 50 includes a fifth wiring slot 60. The third flange 50 may also include a sixth wiring slot 62 and, according to one embodiment, the third flange 50 is integrally formed with the base 44. The third flange 50 is opposite the second flange 48.

Figure 4:
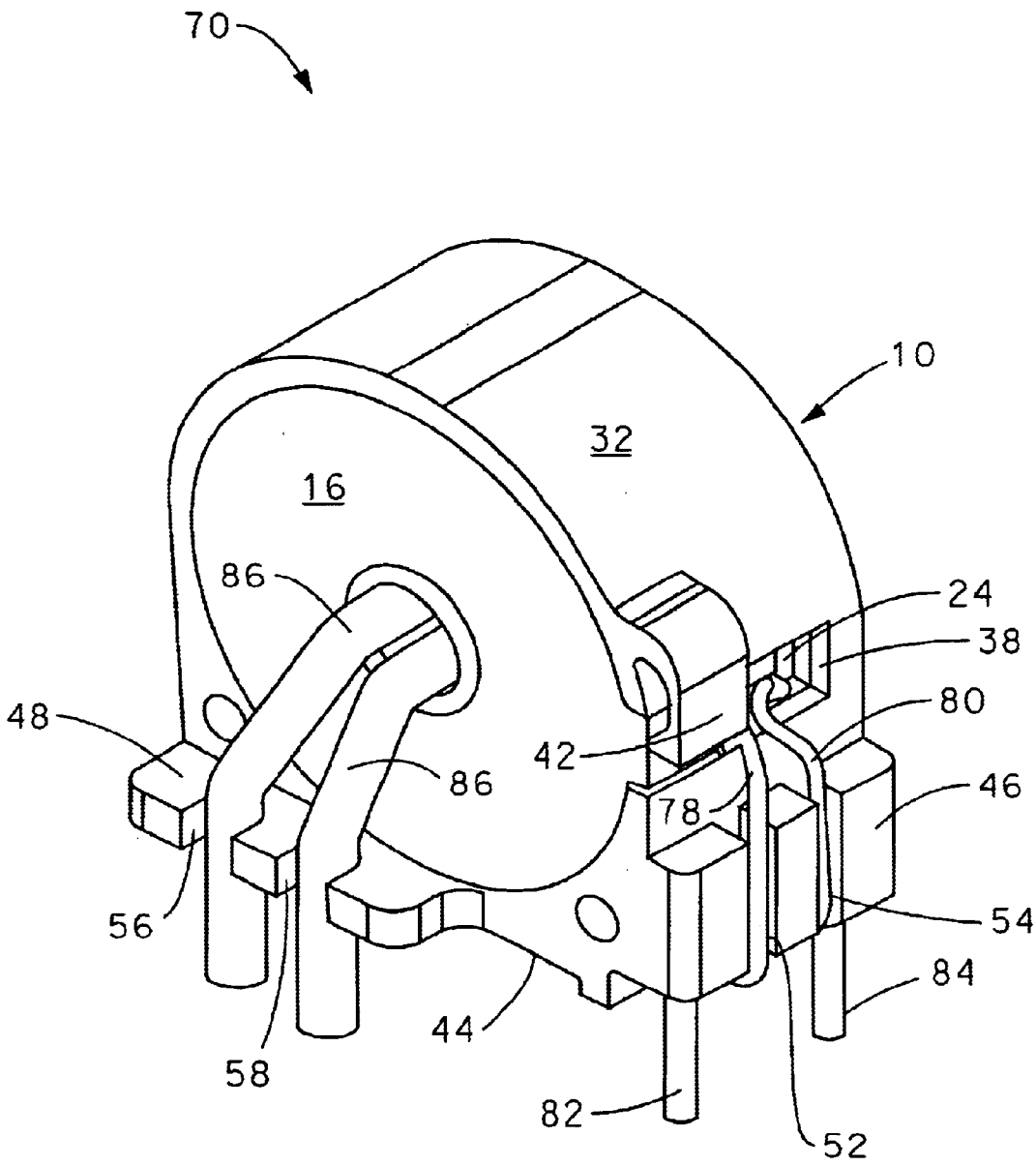
FIG. 4 illustrates one embodiment of a toroidal transformer assembly.
Figure 5:
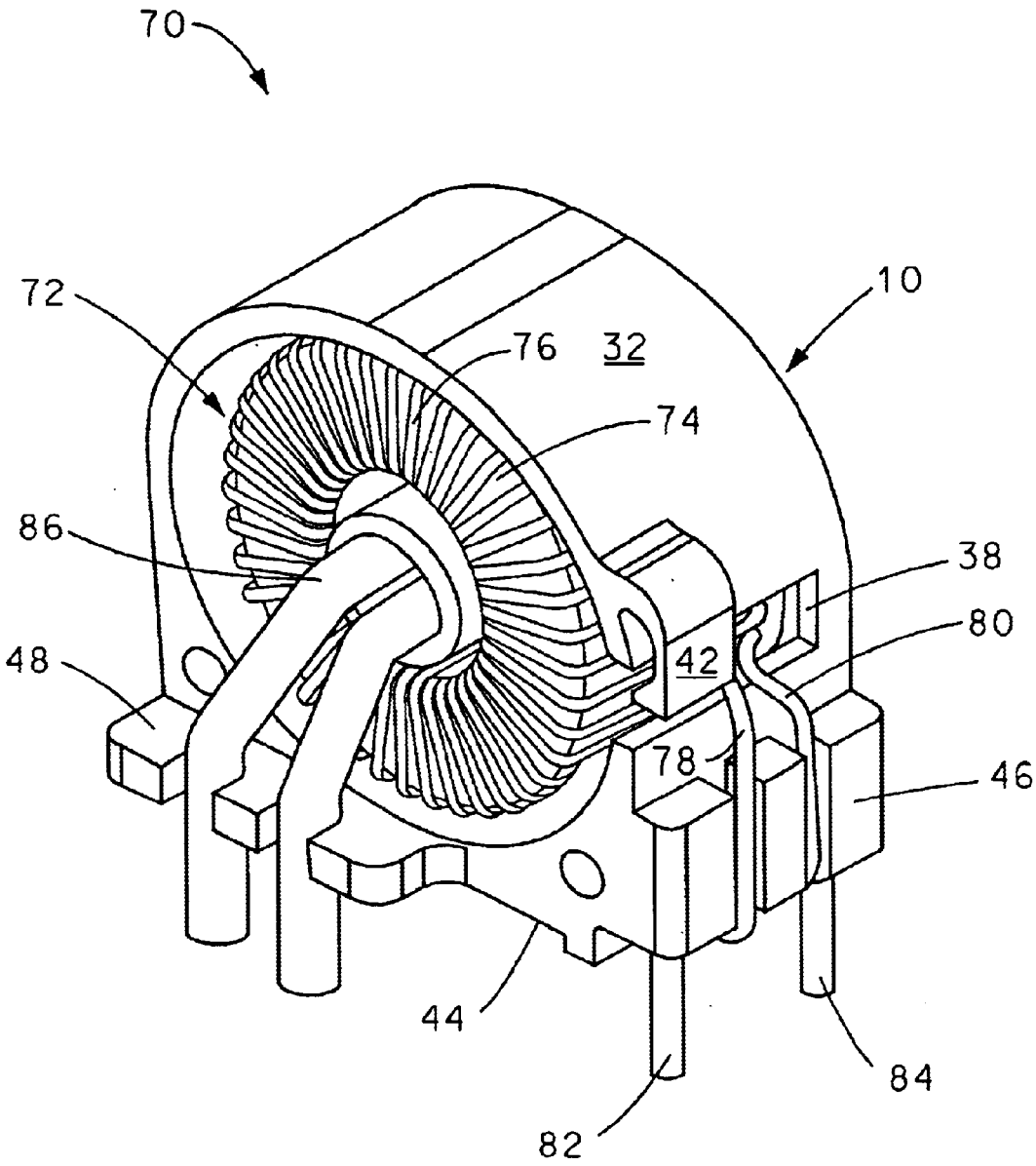
FIG. 5 illustrates one embodiment of a toroidal transformer assembly.

FIGS. 4 and 5 illustrate embodiments of a toroidal transformer assembly 70. The toroidal transformer assembly 70 includes the toroidal transformer enclosure 10 and a toroidal transformer 72 positioned within the toroidal transformer enclosure 10. The design and structure of the toroidal transformer assembly 70 allows it to meet the necessary safety requirements for use in high-voltage applications. For example, according to one embodiment, the toroidal transformer assembly 70 is suitable for applications of up to 400 volts. For illustrative purposes only, FIG. 5 does not show the first housing member 12 of the toroidal transformer enclosure 10.

Figure 7:
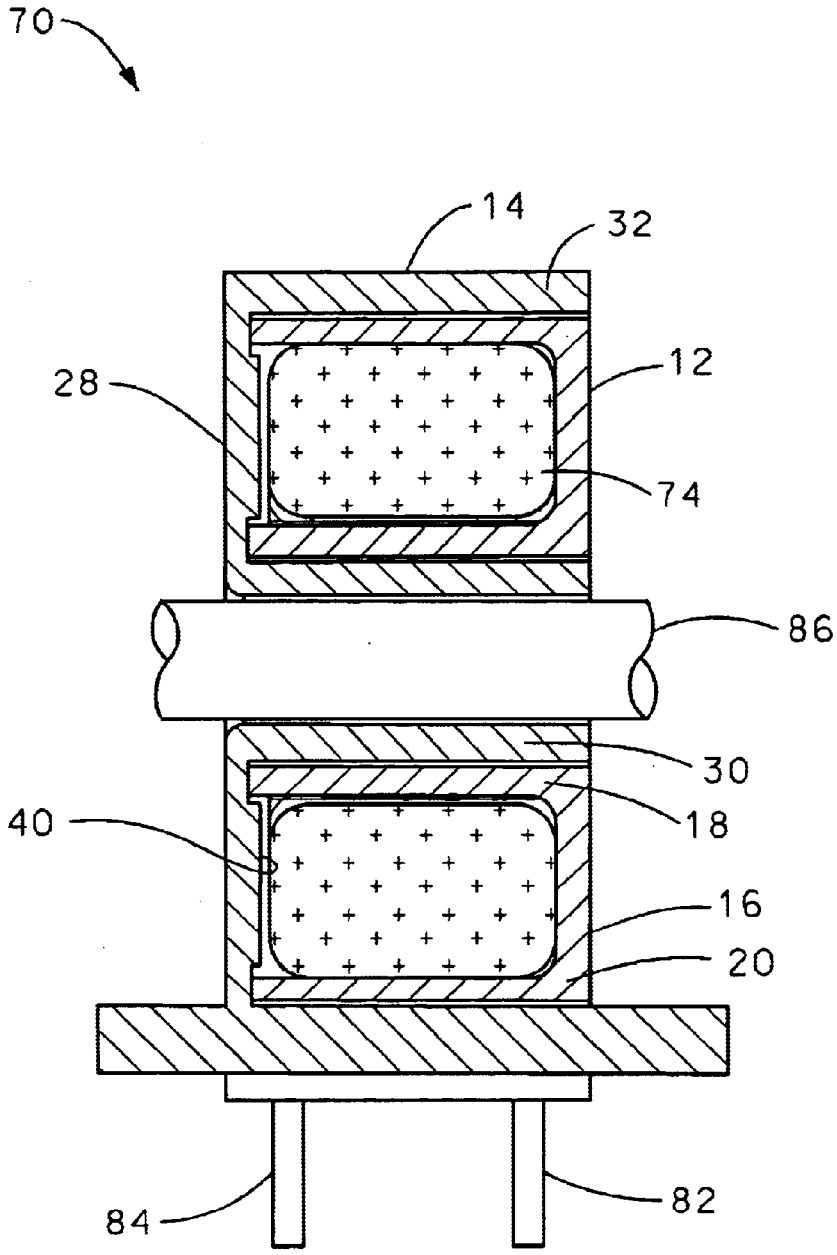
FIG. 7 illustrates a cross-section of the toroidal transformer assembly of FIG. 6 along the line A—A.

The toroidal transformer 72 includes a toroidal shaped magnetic core 74 and a conductive wire 76 wound around the toroidal shaped magnetic core 74. The toroidal shaped magnetic core 74 is positioned between the first and second walls 18, 20 of the first housing member 12 (as shown in FIG. 7). According to one embodiment, the toroidal shaped magnetic core 74, the first wall 18, the second wall 20, the third wall 30 and the fourth surface 36 of the fourth wall 32 are concentric.

As shown in FIG. 4, the conductive wire 76 wound around the toroidal shaped magnetic core 74 includes first and second ends 78, 80 that pass through the first and second enclosure openings 24, 38. The first and second ends 78, 80 also pass through the first and second wiring slots 52, 54, respectively, of the first flange 46 and may be terminated around first and second terminal pins 82, 84, respectively, that are connected to the first flange 46.

The toroidal transformer assembly 70 may further include one or more conductive wires 86 that pass through the first and second central openings 22, 34 and are surrounded by the third wall 30. Thus, the conductive wires 86 pass through a center aperture of the toroidal shaped magnetic core 74. A first end of the conductive wires 86 may pass through the third and fourth wiring slots 56, 58, respectively, of the second flange 48 and a second end of the conductive wires 86 may pass through the fifth and sixth wiring slots 60, 62, respectively, of the third flange 50. According to one embodiment, the conductive wires 86 may be a primary winding and the conductive wire 76 wound around the toroidal shaped magnetic core 74 may be a secondary winding of the toroidal transformer 72.

Figure 6:
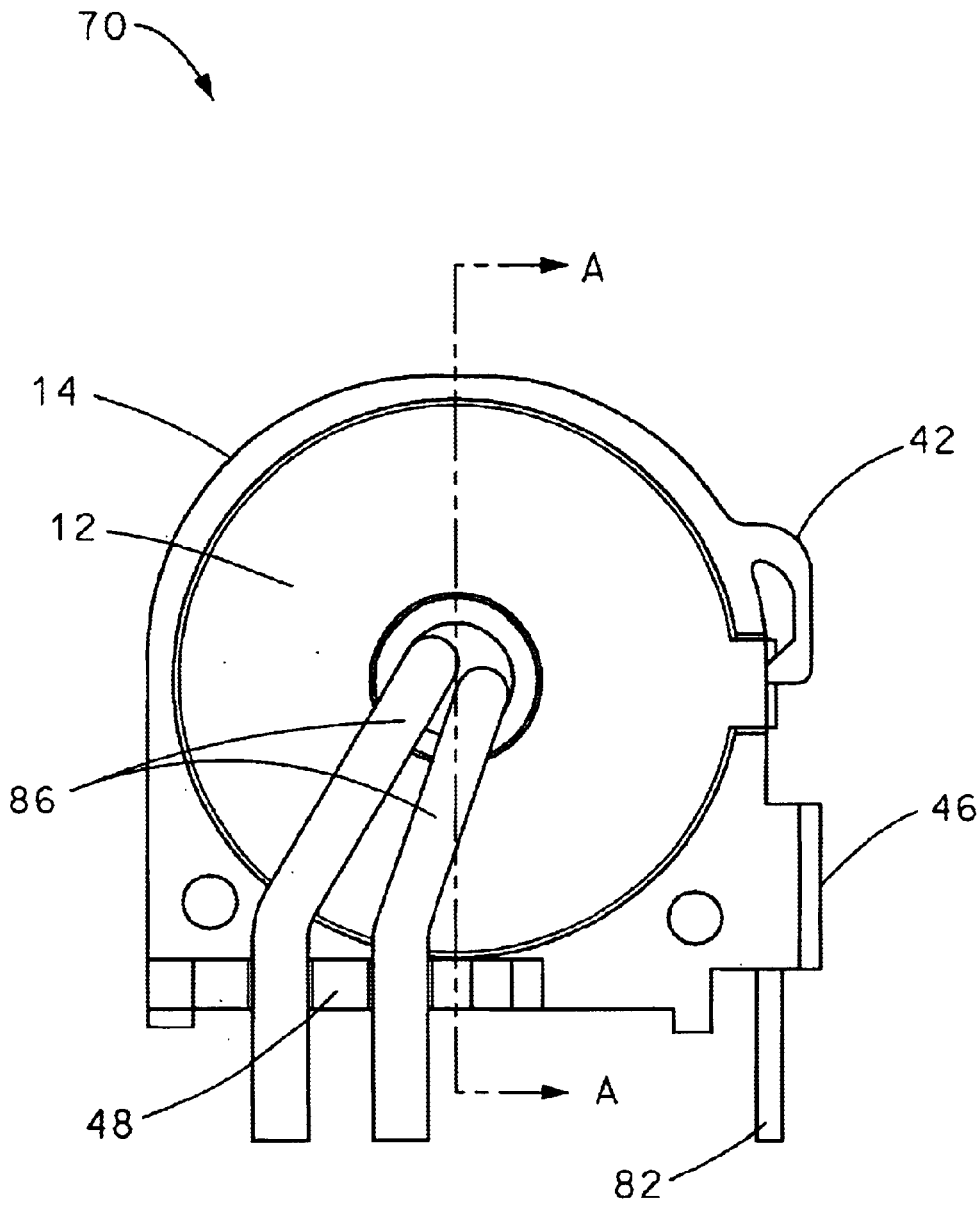
FIG. 6 illustrates one embodiment of a toroidal transformer assembly.
Figure 8:
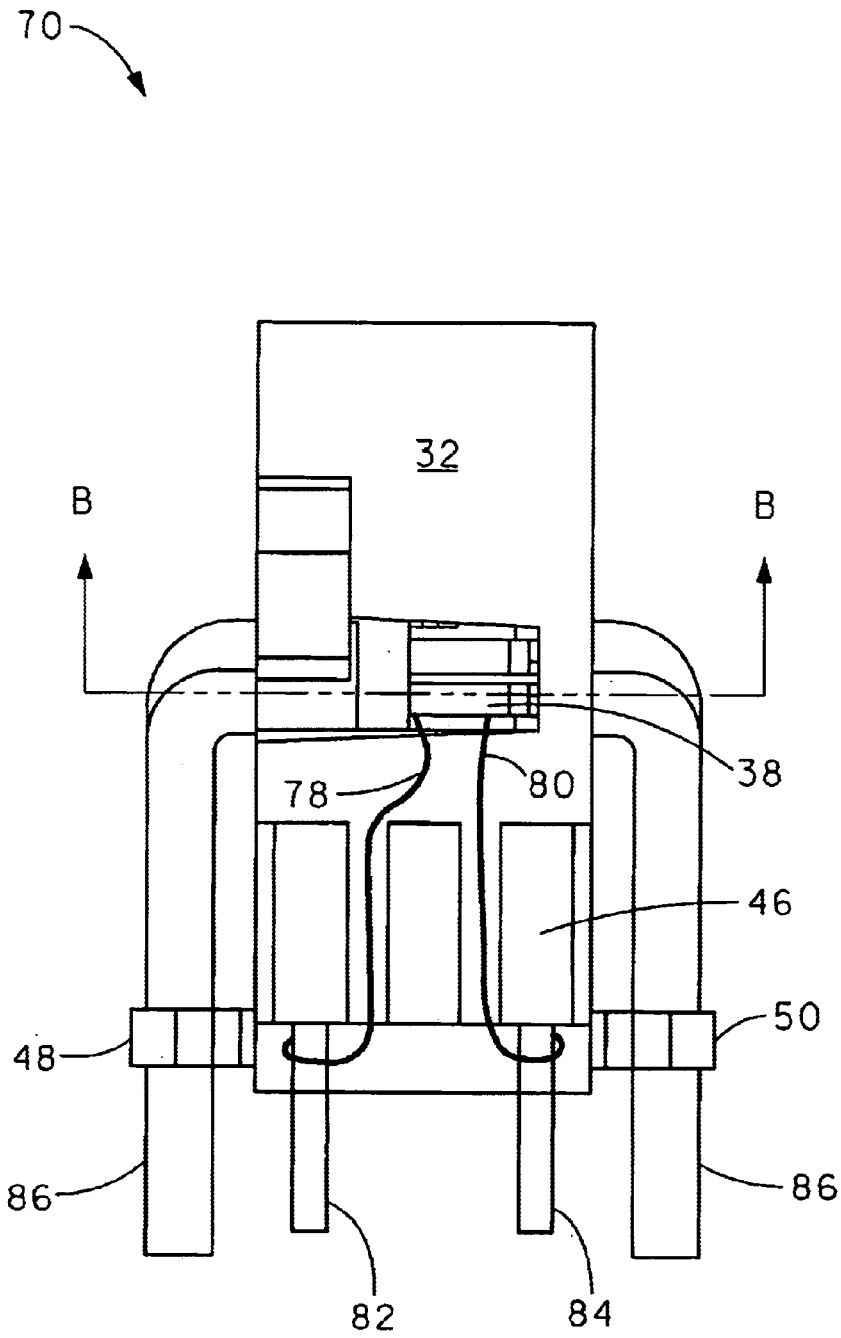
FIG. 8 illustrates one embodiment of a toroidal transformer assembly.
Figure 9:
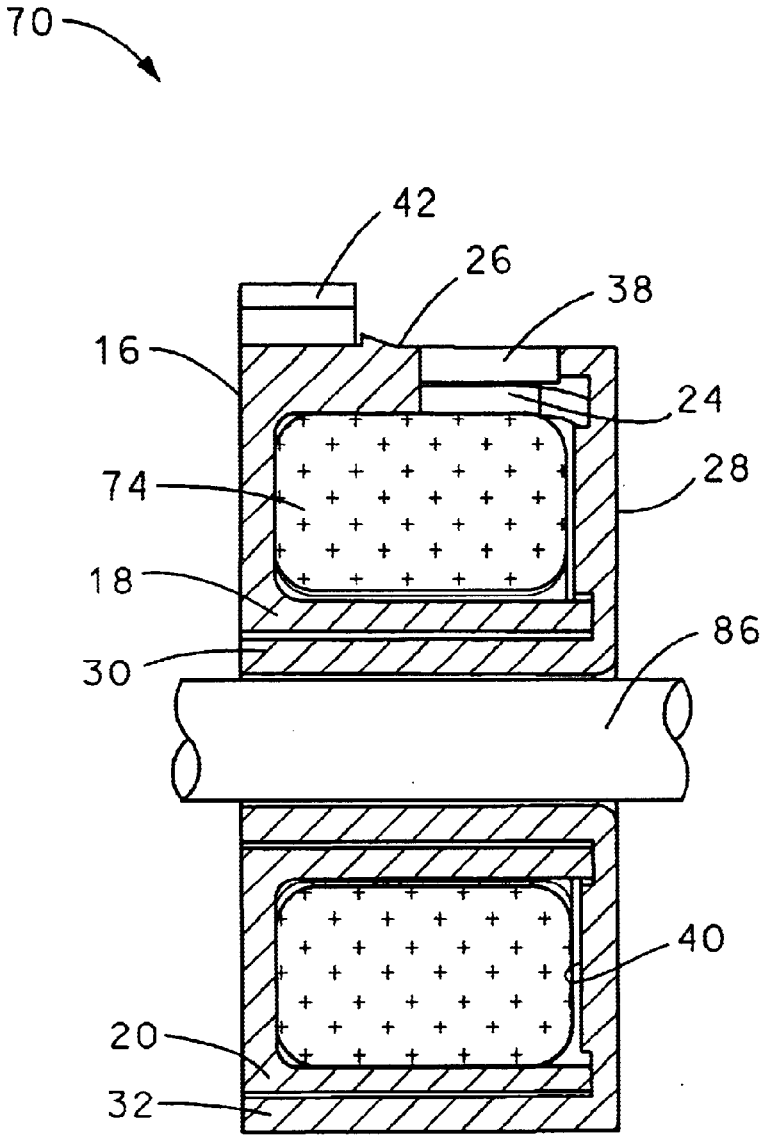
FIG. 9 illustrates a cross-section of the toroidal transformer assembly of FIG. 8 along the line B—B.
Figure 10:
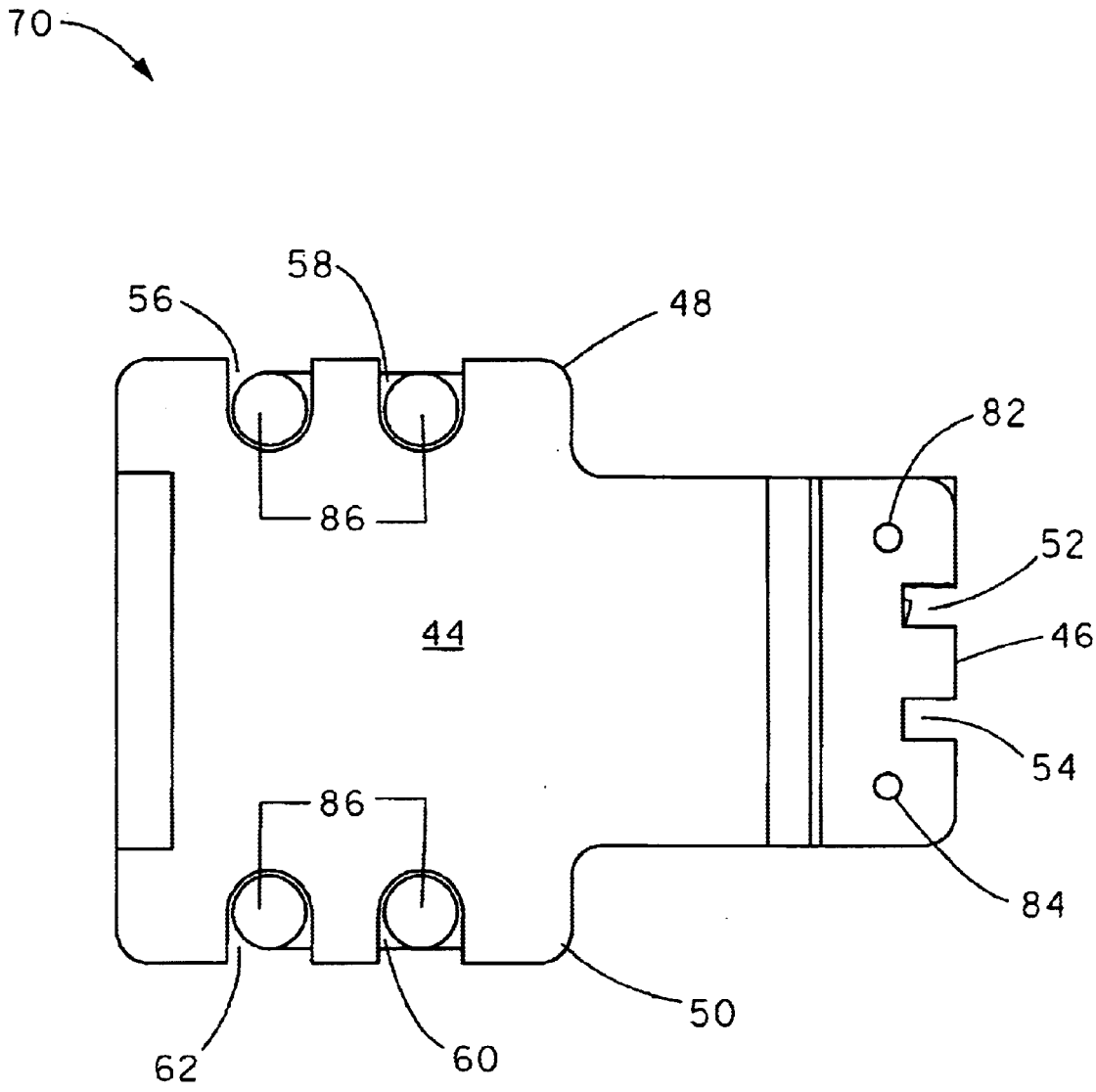
FIG. 10 illustrates a bottom view of one embodiment of a toroidal transformer assembly.

FIG. 6 illustrates one embodiment of a toroidal transformer assembly 70 and FIG. 7 shows a cross-section of the toroidal transformer assembly 70 of FIG. 6 along the line A—A FIG. 8 illustrates one embodiment of a toroidal transformer assembly 70 and FIG. 9 shows a cross-section of the toroidal transformer assembly 70 of FIG. 8 along the line B—B. FIG. 10 illustrates a bottom view of one embodiment of a toroidal transformer assembly 70.

As shown in FIGS. 6–10, the toroidal transformer assembly 70 may be designed to ensure that the creepage distance between any two points on the primary and secondary windings of the toroidal transformer 72 is a certain minimum length in order to meet various safety requirements. The creepage distance can vary depending on the particular creepage distance path used to define the distance between a point of the primary winding and a point on the secondary winding. For example, the creepage distance between the primary winding and a point on the secondary winding at the second enclosure opening 38 may be different than the creepage distance between the primary winding and a point on the secondary winding at the toroidal shaped magnetic core 74 because the creepage distance paths are different.

One creepage distance path between the primary winding and a point on the secondary winding at the second enclosure opening 38 includes two segments. The first segment is from the secondary winding at the second enclosure opening 38 to an outer surface of the second end 28 of the second housing member 14. The second segment is from that point to the first central opening 22. Together, the total length of the two segments may exceed the minimum length required to meet certain safety requirements.

One creepage distance path between the primary winding and a point on the secondary winding at the toroidal shaped magnetic core 74 includes three segments. The first segment is from the secondary winding at the toroidal shaped magnetic core 74 to an outer surface of the second end 28 of the second housing member 14. The second segment is from that point to an outer surface of the second wall 20. The third segment is from that point to an outer surface of the first end 16 of the first housing member 12. Together, the total length of the three segments may exceed the minimum length required to meet certain safety requirements.

Another creepage distance path between the primary winding and a point on the secondary winding at the toroidal shaped magnetic core 74 also includes three segments. The first segment is from the secondary winding at the toroidal shaped magnetic core 74 to an inner surface of the second end 28 of the second housing member 14. The second segment is from that point to an outer surface of the first wall 18. The third segment is from that point to an outer surface of the first end 16 of the first housing member 12. Together, the total length of the three segments may exceed the minimum length required to meet various safety requirements.

Figure 11:
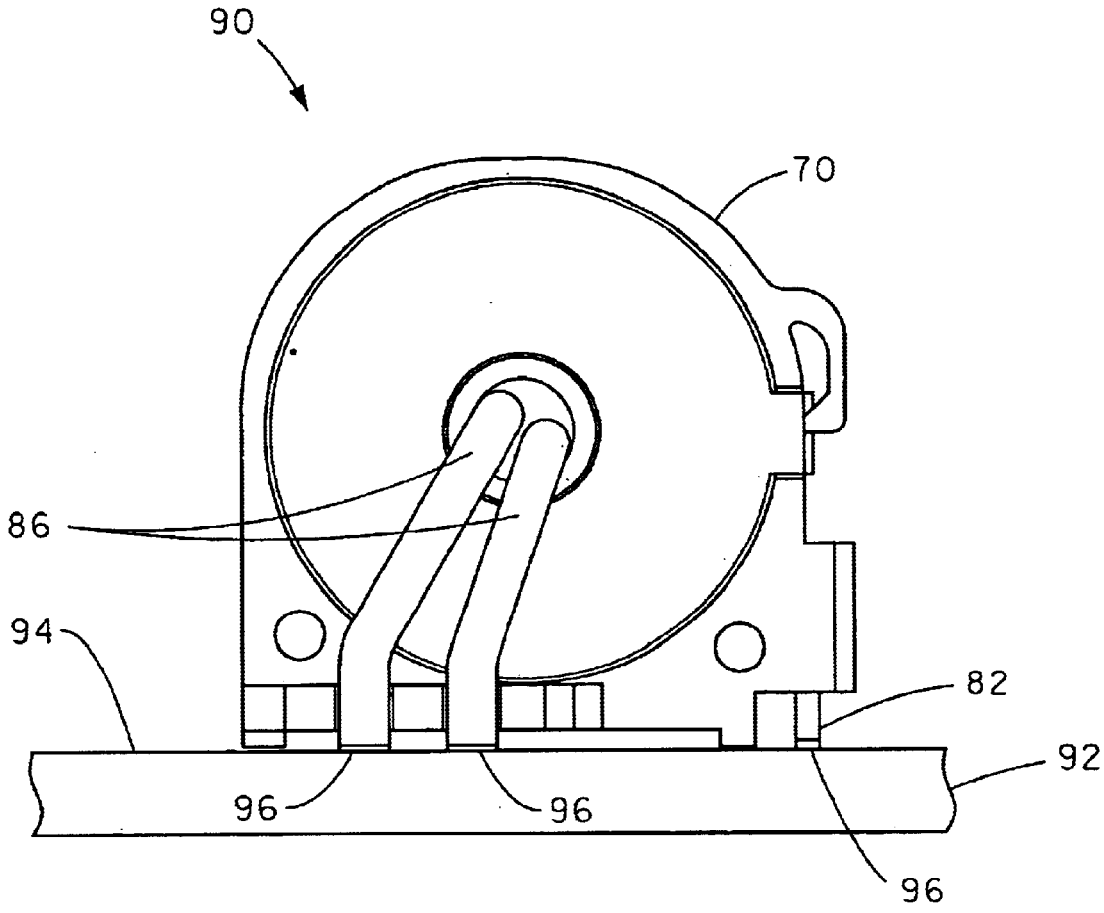
FIG. 11 illustrates one embodiment of an electrical device.

FIG. 11 illustrates a portion of an electrical device 90 such as, for example, a power supply or a portion thereof, including the toroidal transformer assembly 70. As illustrated in FIG. 11, the toroidal transformer assembly 70 is connected to a surface 94 of a printed circuit board 92. According to one embodiment, the toroidal transformer assembly 70 is soldered to the printed circuit board 92. The end portions of the primary winding and secondary windings or terminal pins 82, 84 of the toroidal transformer assembly 70 may be soldered to conductive pads 96 on the surface 94 of the printed circuit board 92. The creepage distance between the primary winding and secondary windings or terminal pins 82, 84 along the surface 94 of the printed circuit board 92 should be greater than a certain minimum length to meet the various safety requirements. One creepage distance path between the primary and secondary windings along the printed circuit board surface 94 would be the shortest edge-to-edge distance between the conductive pads 96 that the primary and secondary windings are electrically connected to. For circular shaped conductive pads, this edge-to-edge distance may be equal to the center-to-center distance between the first terminal pin 82 and the primary winding passing through and secured by the third wiring slot 56 of the second flange 48, less the combined radii of the conductive pads 96. This edge-to-edge distance may also be equal to the center-to-center distance between the second terminal pin 84 and the primary winding passing through and secured by the fifth wiring slot 60 of the third flange 50, less the combined radii of the conductive pads 96.

While several embodiments of the invention have been described, it should be apparent, however, that various modifications, alterations and adaptations to those embodiments may occur to persons skilled in the art with the attainment of some or all of the advantages of the present invention. For example, the first hollow cylinder may be positioned within the third hollow cylinder and the toroidal transformer 72 may be positioned around the third wall 30. It is therefore intended to cover all such modifications, alterations and adaptations without departing from the scope and spirit of the present invention as defined by the appended claims.

What is claimed is:

1. A toroidal transformer enclosure, comprising:

a first housing member including:
- a first end;
- a first wall connected to the first end; and
- a second wall connected to the first end, wherein the second wall surrounds the first wall; and a second housing member structured and arranged to receive the first housing member, the second housing member including:
- a second end;
- a third wall connected to the second end; and
- a fourth wall connected to the second end, wherein the fourth wall surrounds the third wall and defines a spacing therebetween, and wherein the first and second walls are disposed in the spacing between the third and fourth wall when the first housing member is received by the second housing member.

2. The toroidal transformer enclosure of claim 1, wherein the first and second housing members are fabricated from an electrically insulative material.

3. The toroidal transformer enclosure of claim 1, wherein the first end of the first housing member is substantially planar.

4. The toroidal transformer enclosure of claim 3, wherein the first end of the first housing member defines a first central opening.

5. The toroidal transformer enclosure of claim 4, wherein the first end is integrally formed with the first and second walls.

6. The toroidal transformer enclosure of claim 5, wherein the second end of the second housing member is substantially planar.

7. The toroidal transformer enclosure of claim 6, wherein the second end of the second housing member defines a second central opening.

8. The toroidal transformer enclosure of claim 7, wherein the second end is integrally formed with the third and fourth walls.

9. The toroidal transformer enclosure of claim 8, wherein:

the first wall defines a first hollow cylinder; and the second wall defines a second hollow cylinder, wherein the second hollow cylinder surrounds the first hollow cylinder.

10. The toroidal transformer enclosure of claim 9, wherein the first and second walls are concentric.

11. The toroidal transformer enclosure of claim 9, wherein:

the third wall defines a third hollow cylinder; and the fourth wall includes a first surface that defines a fourth hollow cylinder, wherein the fourth hollow cylinder surrounds the third hollow cylinder.

12. The toroidal transformer enclosure of claim 11, wherein the third and fourth walls are concentric.

13. The toroidal transformer enclosure of claim 11, wherein the first end of the first housing member is opposite the second end of the second housing member when the first housing member is received by the second housing member.

14. The toroidal transformer enclosure of claim 13, wherein the first hollow cylinder surrounds the third hollow cylinder when the first housing member is received by the second housing member.

15. The toroidal transformer enclosure of claim 14, wherein the fourth hollow cylinder surrounds the second hollow cylinder when the first housing member is received by the second housing member.

16. The toroidal transformer enclosure of claim 15, wherein the first wall, second wall, third wall and first surface of the fourth wall are concentric when the first housing member is received by the second housing member.

17. The toroidal transformer enclosure of claim 15, wherein:

the second wall defines a first enclosure opening; and the fourth wall defines a second enclosure opening, wherein the first and second enclosure openings are aligned when the first housing member is received by the second housing member.

18. The toroidal transformer enclosure of claim 17, wherein:

the first housing member further includes a locking ramp connected to the second wall; and the second housing member further includes a locking latch connected to the fourth wall, wherein the locking ramp and the locking latch cooperate to connect the first housing member to the second housing member when the first housing member is received by the second housing member.

19. The toroidal transformer enclosure of claim 18, wherein:

the locking ramp is integrally formed with the second wall; and the locking latch is integrally formed with the fourth wall.

20. The toroidal transformer enclosure of claim 19, wherein the second housing member further includes a standoff connected to the fourth wall.

21. The toroidal transformer enclosure of claim 20, wherein the standoff is integrally formed with the fourth wall.

22. The toroidal transformer enclosure of claim 21, wherein the second housing member further includes:

a base connected to the second end;

a first flange connected to the fourth wall, wherein the first flange includes first and second wiring slots;

a second flange connected to the base, wherein the second flange includes a third wiring slot; and a third flange connected to the base, wherein the third flange includes a fourth wiring slot.

23. The toroidal transformer assembly of claim 22, wherein the base is integrally formed with the second end and the fourth wall.

24. The toroidal transformer enclosure of claim 23, wherein the first flange is integrally formed with the fourth wall.

25. The toroidal transformer enclosure of claim 24, wherein the second and third flanges are integrally formed with the base.

26. The toroidal transformer enclosure of claim 25, wherein:

the second flange includes a fifth wiring slot; and the third flange includes a sixth wiring slot.

27. The toroidal transformer enclosure of claim 26, wherein the second flange is opposite the third flange.

28. A toroidal transformer assembly, comprising:

a toroidal transformer enclosure, wherein the toroidal transformer enclosure includes:

a first housing member, wherein the first housing member includes:

a first housing member having a first end;

a first wall connected to the first end; and a second wall connected to the first end, wherein the second wall surrounds the first wall; and a second housing member connected to the first housing member, wherein the second housing member includes:

a second end, wherein the second end is opposite the first end of the first housing member;

a third wall connected to the second end; and a fourth wall connected to the second end, wherein the fourth wall surrounds the third wall and defines a spacing therebetween, and wherein the first and second walls are disposed in the spacing between the third and fourth walls; and a toroidal transformer positioned between the first and second walls.

29. The toroidal transformer assembly of claim 28, wherein the toroidal transformer, the first wall, the second wall, the third wall and a first surface of the fourth wall are concentric.

30. An electrical device, comprising:

a printed circuit board; and a toroidal transformer assembly connected to a surface of the printed circuit board, wherein the toroidal transformer assembly includes:

a toroidal transformer enclosure, wherein the toroidal transformer enclosure includes:

a first housing member, wherein the first housing member includes:

a first end;

a first wall connected to the first end; and a second wall connected to the first end, wherein the second wall surrounds the first wall; and a second housing member connected to the first housing member wherein the second housing member includes:

a second end, wherein the second end is opposite the first end of the first housing member;

a third wall connected to the second end; and a fourth wall connected to the second end, wherein the fourth wall surrounds the third wall and defines a spacing therebetween, and wherein the first and second walls are disposed in the spacing between the third and fourth walls; and a toroidal transformer positioned between the first and second walls.

31. The electrical device of claim 30, wherein the electrical device is a power supply.

32. The electrical device of claim 30, wherein the toroidal transformer assembly is soldered to the printed circuit board.

* * * * *